US005723405A

United States Patent [19]

Hastreiter, Jr. et al.

[11] Patent Number: 5,723,405

[45] Date of Patent: Mar. 3, 1998

[54] ADHESIVE FOR LAMINATING THERMAL DYE TRANSFER PRINT

[75] Inventors: Jacob J. Hastreiter, Jr., Spencerport; William H. Simpson, Pittsford, both of N.Y.

[73] Assignee: Eastman Kodak Company, Rochester, N.Y.

[21] Appl. No.: 757,986

[22] Filed: Nov. 27, 1996

[51] Int. Cl.[6] ..... B41M 5/035; B41M 5/38; B41M 5/40

[52] U.S. Cl. ..... 503/227; 156/235; 428/195; 428/341; 428/913; 428/914

[58] Field of Search ..... 8/471; 156/230, 156/235; 428/195, 341, 913, 914; 503/227

[56] References Cited

U.S. PATENT DOCUMENTS 5,332,713 7/1994 Oldfield et al. ..... 503/227

OTHER PUBLICATIONS

U.S. Patent Application 08/688,975 of Reiter et al, filed Jul. 31, 1996.

U.S. Patent Application 08/684,899 of Simpson et al, filed Jul. 25, 1996.

*Primary Examiner*—Bruce H. Hess

*Attorney, Agent, or Firm*—Harold E. Cole

[57] ABSTRACT

A dye-receiver element comprising a support having thereon a dye-receiving layer containing a thermally-transferred dye image, the dye-receiving layer being laminated to a transparent protective sheet by means of an adhesive comprising a phenoxy resin.

10 Claims, No Drawings

ADHESIVE FOR LAMINATING THERMAL DYE TRANSFER PRINT

This invention relates to a thermal dye transfer receiving element which has a protective sheet laminated thereto using a particular adhesive.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to one of the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Thermal prints are susceptible to retransfer of dyes to adjacent surfaces and to discoloration by fingerprints. Also, dye fading may occur from fingerprint marking because the image dyes are located at the surface. These dyes can be driven further into the dye-receiving layer by thermally fusing the print with either hot rollers or a thermal head. This will help to reduce dye retransfer and fingerprint susceptibility, but does not eliminate these problems. However, the application of a protective overcoat will practically eliminate these problems.

Co-pending U.S. patent application Ser. No. 08/688,975 of Reiter et al. relates to a composite thermal dye transfer ID card stock. There is a disclosure in this application that a clear, protective sheet may be applied to the card using a laminator with heat and pressure. However, no specific materials for the protection sheet are mentioned.

U.S. Pat. No. 5,332,713 and co-pending U.S. patent application Ser. No. 08/684,899 of Simpson et at. disclose a dye-donor element for thermal dye transfer wherein a transparent protection overcoat, such as poly(vinyl acetal) or a phenoxy resin, is also present on the element which is used to form a protective layer over the printed image. These protective overcoats work very well with thermally printed material which is used as a photographic reproduction.

However, there is a problem with the application of a protective overcoat to a thermally-generated image on an identification card, such as a driver's license, national ID cards, bank and other authority cards, because they additionally need resistance to abrasion and chemical attack. Abrasive attack may include dirt, sand, fabrics, leathers or the abrasion of one identification card against another. Since the protective overcoats in the prior art described above have a thickness of less than one micron, the protected image can readily be damaged or destroyed by abrasive attack.

Chemical attack may also be a problem due to contact of an ID card with solutions or solvents including water/alcohol mixtures, household bleach, organic solvents and automotive fuel. Since commonly-used thermally transferred protective layers are coated from solutions composed of the dissolved polymer and a solvent, the resultant protective layer may be easily redissolved. Similarly, many of the adhesives used for bonding durable topcoats to an image are solvent-coated. Since the coated adhesive may be easily redissolved, chemical attack on the image could start with solvent diffusion from unprotected edges.

It is an object of this invention to provide a protective laminate for a thermal dye transfer image which exhibits superior adhesiveness and resistance to delamination and abrasion, as well as chemical stability on contact with commonly encountered solvents. It is another object to provide a protective laminate for a thermal dye transfer image wherein image stability and integrity are enhanced.

These and other objects are achieved in accordance with this invention which relates to a dye-receiver element comprising a support having thereon a dye-receiving layer containing a thermally-transferred dye image, the dye-receiving layer being laminated to a transparent protective sheet by means of an adhesive comprising a phenoxy resin.

Another embodiment of the invention relates to a process of laminating a transparent protection sheet on top of a thermal dye transfer image comprising:

(I) imagewise-heating a dye-donor element comprising a support having thereon a dye layer comprising an image dye in a binder, the dye-donor being in contact with a dye-receiving element, thereby transferring a dye image to the dye-receiving element to form the dye transfer image; and (II) thermally laminating the transparent protection sheet on top of the transferred dye image by means of an adhesive comprising a phenoxy resin.

Any phenoxy resin known to those skilled in the art may be used in the invention. For example, there may be employed the following: Paphen® resins such as Phenoxy Resins PKHC®, PKI-IH® and PKHJ® from Phenoxy Associates, Rock Hill, S.C.; and 045A and 045B resins from Scientific Polymer Products, Inc. Ontario, N.Y. which have a mean number molecular weight of greater than about 10,000. In a preferred embodiment of the invention, the phenoxy resin is a Phenoxy Resin PKHC®, PKHH® or PKI-IJ® having the following formula:

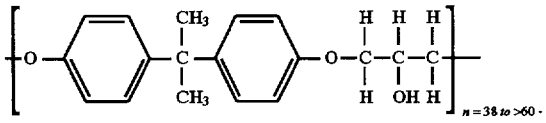

The phenoxy adhesive employed in the invention may be used in an mount of at least about 0.5 g/m$^2$ as coated on the protective sheet.

In another preferred embodiment of the invention, various crosslinking agents may be employed with the adhesive such as titanium alkoxides, polyisocyanates, melamine-formaldehyde, phenol-formaldehyde, urea-formaldehyde, vinyl sulfones and silane coupling agents such as tetraethylorthosilicate. In a preferred embodiment of the invention, the crosslinking agent is a titanium alkoxide such as titanium tetra-isopropoxide or titanium butoxide. In general, good results have been obtained when the crosslinking agent is present in an mount of from about 0.01 g/m$^2$ to 0.045 g/m$^2$.

The transparent protective sheet employed in the invention may be, for example, polyesters such as poly(ethylene terephthalate), poly(ethylene naphthalate); polycarbonates; cellulose esters such as cellulose acetate; polyolefins such as polystyrene, polyethylene, polypropylene or methylpentene polymers; poly(vinyl chloride), poly(vinylidene chloride);

or polyacrylates such as polymethyimethacrylate. The protective sheet may be coated with a subbing layer such as a titanium alkoxide, if desired. The thickness of the transparent protective sheet may be, for example, from about 4 μm to about 250 μm.

The present invention provides a protective overcoat sheet applied to a thermal print by uniform application of heat using a laminator such as Kodak Readyprint Photo Laminator (Eastman Kodak Co., Rochester, N.Y.), or any device capable of providing heat and pressure.

By use of the invention, the laminated protective sheet provides superior protection of the thermal image against image deterioration due to exposure to light, common chemicals, such as grease and oil from fingerprints, and plasticizers from film album pages or sleeves made of poly(vinyl chloride).

Yellow, magenta and cyan dyes can be thermally transferred from a dye-donor element to form a multicolor image on the dye-receiving sheet. Any dye can be used in the dye layer of the dye-donor element used in the invention provided it is transferable to the dye-receiving layer by the action of heat. Especially good results have been obtained with sublimable dyes. Examples of sublimable dyes include anthraquinone dyes, e.g., Sumikaron Violet RS® (Sumitomo Chemical Co., Ltd.), Dianix Fast Violet 3R FS® (Mitsubishi Chemical Industries, Ltd.), and Kayalon Polyol Brilliant Blue N BGM® and KST Black 146® (Nippon Kayaku Co., Ltd.); azo dyes such as Kayalon Polyol Brilliant Blue BM®, Kayalon Polyol Dark Blue 2BM®, and KST Black KR® (Nippon Kayaku Co., Ltd.), Sumikaron Diazo Black 5G® (Sumitomo Chemical Co., Ltd.), and Miktazol Black 5GH® (Mitsui Toatsu Chemicals, Inc.); direct dyes such as Direct Dark Green B® (Mitsubishi Chemical Industries, Ltd.) and Direct Brown M® and Direct Fast Black D® (Nippon Kayaku Co. Ltd.); acid dyes such as Kayanol Milling Cyanine 5R® (Nippon Kayaku Co. Ltd.); basic dyes such as Sumiacryl Blue 6G® (Sumitomo Chemical Co., Ltd.), and Aizen Malachite Green®(Hodogaya Chemical Co., Ltd.);

Yellow Dye 1

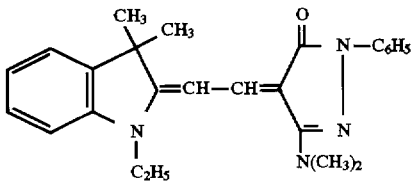

Magenta Dye 2

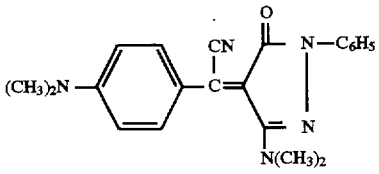

Magenta Dye 3

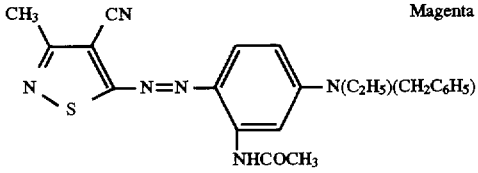

-continued

Cyan Dye 4

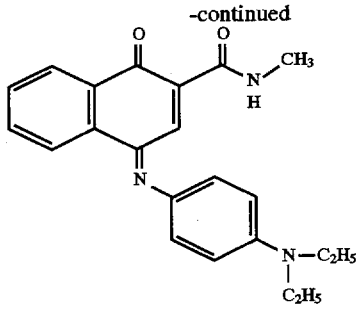

Cyan Dye 5

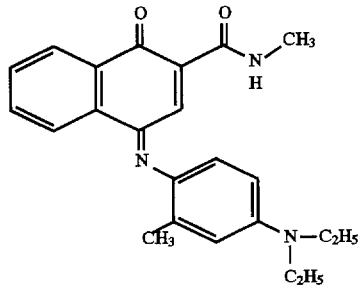

Cyan Dye 6

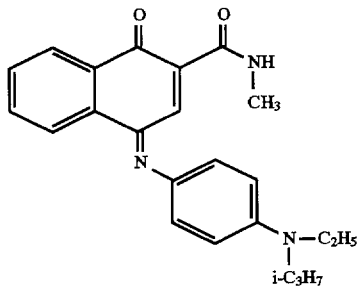

or any of the dyes disclosed in U.S. Pat. No. 4,541,830, the disclosure of which is hereby incorporated by reference. The above dyes may be employed singly or in combination to obtain a monochrome. The dyes may be used at a coverage of from about 0.05 to about 1 g/m$^2$ and are preferably hydrophobic.

The dye-receiving element that is used in the invention comprises a support having thereon a dye image-receiving layer. The support may be a transparent film such as a poly(ether sulfone), a polyimide, a cellulose ester such as cellulose acetate, a poly(vinyl alcohol-co-acetal) or a poly (ethylene terephthalate). The support for the dye-receiving element may also be reflective such as baryta-coated paper, polyethylene-coated paper, white polyester (polyester with white pigment incorporated therein), an ivory paper, a condenser paper, a synthetic paper such as DuPont Tyvek®, or a laminated, microvoided, composite packaging film support as described in U.S. Pat. 5,244,861.

The dye image-receiving layer may comprise, for example, a polycarbonate, a polyurethane, a polyester, poly (vinyl chloride), poly(styrene-co-acrylonitrile), polycaprolactone or mixtures thereof. The dye image-receiving layer may be present in any amount which is effective for the intended purpose. In general, good results have been obtained at a concentration of from about 1 to about 5 g/m$^2$.

As noted above, the dye donor elements employed in the invention are used to form a dye transfer image. Such a process comprises imagewise heating a dye-donor element as described above and transferring a dye image to a dye receiving element to form the dye transfer image. After the dye image is transferred, the transparent protection sheet is then laminated on top of the transferred dye image.

The following example is provided to illustrate the invention.

EXAMPLE

A dye-donor element was prepared by coating on a 6 μm poly(ethylene terephthalate) support:

1) a subbing layer of titanium butoxide (DuPont Tyzor TBT)® (0.12 g/m$^2$) from a n-propyl acetate and n-butyl alcohol solvent mixture, and
2) repeating yellow, magenta and cyan dye patches containing the compositions as described below.

On the back side of the element were coated the following layers in sequence:

1) a subbing layer of titanium butoxide (DuPont Tyzor TBT)® (0.12 g/m$^2$) from a n-propyl acetate and n-butyl alcohol solvent mixture, and
2) a slipping layer containing an aminopropyl-dimethyl-terminated polydimethylsiloxane, PS-513® (United Chemical Technologies, Bristol, Pa.)(0.01 g/m$^2$), a poly (vinyl acetal) binder (0.38 g/m$^2$) (KS-1, Sekisui Chemical Co.), p-tohenesulfonic acid (0.0003 g/m$^2$), candelilla wax (0.02 g/m$^2$), coated from diethyl ketone.

The yellow composition contained 0.27 g/m$^2$ of the Yellow Dye 1 illustrated above, 0.07 g/m$^2$ of CAP 482-0.5 (cellulose acetate propionate) 0.5 s viscosity (Eastman Chemical Co.), 0.287 g/m$^2$ of CAP 482-20 (cellulose acetate propionate) 20 s viscosity (Eastman Chemical Co.), 0.002 g/m$^2$ of FC-430® fluorocarbon surfactant (3M Corp.) in a solvent mixture of toluene, methanol and cyclopentanone (66.5/28.5/5).

The magenta composition contained 0.18 g/m$^2$ of the Magenta Dye 2 illustrated above, 0.17 g/m$^2$ of Magenta Dye 3 illustrated above, 0.17 g/m$^2$ of CAP 482-0.5 (cellulose acetate propionate) 0.5 s viscosity (Eastman Chemical Co.), 0.31 g/m$^2$ of CAP 482-20 (cellulose acetate propionate) 20 s viscosity (Eastman Chemical Co.), 0.07 g/m$^2$ of 2,4,6-trimethylanilide of phenyl-indanediacid, 0.002 g/m$^2$ of FC-430® fluorocarbon surfactant (3M Corp.) in a solvent mixture of toluene, methanol and cyclopentanone (66.5/28.5/5).

The cyan composition contained Cyan Dye 4 at 0.127 g/m$^2$, Cyan Dye 5 at 0.115 g/m$^2$, Cyan Dye 6 at0.275 g/mL 0.30 g/m$^2$ of CAP 482-20 (cellulose acetate propionate) 20 s viscosity (Eastman Chemical Co.), and Fluorad FC-430® fluorocarbon surfactant (3M Corp.) ( 0.002 g/m$^2$) in a solvent mixture of toluene, methanol and cyclopentanone (66.5/28.5/5).

B. Receiver Element:

The receiver element consisted of four layers coated on 195 μm poly(ethylene terephthalate) support, Estar® (Eastman Kodak Co.) which was then laminated to a poly (ethylene terephthalate) core (KODADIRECT PET® Card, Eastman Kodak Co.).

The first layer, coated directly on the support, consisted of a copolymer of butyl acrylate and acrylic acid (50/50 wt. %) at 8.07 g/m$^2$, 1,4-butanediol diglycidyl ether (Eastman Kodak Co.) at 0.57 g/m$^2$, tributylamine at 0.32 g/m$^2$ and Fluorad® FC-431 surfactant (3M Corp.) at 0.016 g/m$^2$.

The second layer consisted of a copolymer of 14 mole-% acrylonitrile, 79 mole-% vinylidine chloride, and 7 mole-% acrylic acid at 0.54 g/m$^2$, and DC-1248 silicone fluid (Dow Corning) at 0.016 g/m$^2$.

The third layer consisted of Makrolone KL3-1013 polycarbonate (Bayer AG) (1.78 g/m$^2$) and Lexan® 141-112 polycarbonate (General Electric Co.) (1.44 g/m$^2$), dibutyl phthalate (Bastman Kodak Co.) (0.32 g/m$^2$), diphenyl phthalate (Eastman Kodak Co.) (0.32 g/m$^2$), and Fluorad® FC-431 (0.012 g/m$^2$).

The fourth, topmost layer, of the element consisted of a copolymer of 50 mole-% bisphenol A, 49 mole-% diethylene glycol and 1 mole-% of a polydimethylsiloxane block (0.65 g/m$^2$), Fluorad® FC-43 1 (0.054 g/m$^2$), and DC-510 (Dow Coming Co.) (0.054 g/m$^2$).

C. Printing Conditions

The dye side of the dye-donor element as described above was placed in contact with the topmost layer of the receiver element as described above. The assemblage was placed between a motor driven platen and a Kyocera KBF-57-12MGL2 thermal print head which was pressed against the slip layer side of the dye-donor element with a force of 31.2 N. The Kyocera print head has 672 independently addressable heaters with a resolution of 11.81 dots/mm of average resistance 1968 Ω. The imaging electronics were activated and the assemblage was drawn between the print head and the roller at 26.67 mm/s. Coincidentally, the resistance elements in the thermal print head were pulsed on for 87.5 microseconds every 91 microseconds. Printlug maximum density required 32 pulses "on" time per printed line of 3.175 milliseconds. The voltage supplied was 14.0 volts resulting in an energy of 4.4 J/cm$^2$ to print a maximum Status A density of 2.2 to 2.3. The image was printed with a 1:1 aspect ratio.

D. Durable Topcoat (DTC)

DTC Control #1

An element comprised of Bostik® 7962 polymer polyester resin (Bostik Inc., Middleton, Mass.) at a laydown of 1.08 g/m$^2$ and Fluorad®FC-431 at 0.011 g/m$^2$ was prepared and applied to a substrate consisting of 19.8 μm poly(ethylene terephthaate) PET film (Type 37R, Toray Polyester), which had been subbed with Tyzor TBT® titanium tetrabutoxide (DuPont) at a laydown of 0.139 g/m$^2$.

DTC Control #2

This is the same as Control #1 except that the laydown was 2.16 g/m$^2$.

DTC Experiment #1

An element comprised of PKHI® phenoxy resin (Phenoxy Associates, Rock Hill, S.C.) at 1.08 g/m$^2$ 4 μm divinylbenzene beads at 86 g/m$^2$, and a microgel (67 mole-% isobutyl methacrylate, 30 mole-% 2-ethylhexyl methacrylate, 3 mole-% divinylbenzene) at 0.0108 g/m$^2$. The element was coated on a substrate consisting of 19.8 μm PET film, which had been subbed with Tyzor TBT®.

DTC Experiment #2

This is the same as DTC Experiment #1 with the addition of 0.043 g/m$^2$ of Tyzor TBT®.

DTC Experiment #3

This is the same as DTC Experiment #1 except that the PKHJ® phenoxy resin was coated at 0.54 g/m$^2$ and the divinylbenzene beads were coated at 0.09 g/m$^2$.

DTC Experiment #4

This is the same as DTC Experiment #3 with the addition of 0.022 g/m$^2$ of Tyzor TBT®.

DTC Experiment #5

This is the same as DTC Experiment #1 except that the phenoxy resin was Catalog No. 045B (Scientific Polymer Products, Inc., Ontario, N.Y.) and the divinylbenzene beads were coated at g/m$^2$.

E. Lamination of DTC

The DTC was laminated to the receiver element by placing the coated side of the DTC element described above in contact with the topmost layer of the previously described image-bearing receiver element. This sandwich was placed into a sleeve fabricated from a manila file folder and the assemblage was fed into a thermostatically controlled Kodak Readyprint Photo Laminator (Eastman Kodak Co., Rochester, N.Y.).

F. Adhesion

The force necessary to remove the DTC was measured after lamination of the DTC to the topmost layer of the receiver element. The samples were first imaged with a neutral density pattern and the DTC was applied as described above. After application of the DTC, 180° peel tests were conducted to measure the adhesive qualifies of the DTC.

A one inch wide strip was longitudinally cut through the DTC. The laminated image was firmly held by a stationary clamp and the tag end of the DTC attached to a Challion Model DFG-10 Digital Force Gauge (John Chatlion & Sons, Inc., Greensboro, N.C.) mounted on a motor-driven platen. The platen speed was 0.714 cm/s. When activated, the platen with attached force gauge would attempt to pull the DTC from the imaged material. Force measurements were calculated in Newton/cm.

Once applied, a DTC should not be removable. If removal of the DTC is attempted, the DTC should tear or damage the Underlying image thereby deterring further alteration attempts. The results of the evaluation are given in Tables 1 and 2.

TABLE 1

| Lamination Temperature of 350° F. | | |
|---|---|---|
| DTC | PEEL FORCE (N/cm) | RESULTS* |
| Control #1 | 0.0 | x |
| Experiment #1 | 2.5 | + |
| Experiment #2 | 2.7 | + |
| Experiment #3 | 2.6 | + |
| Experiment #4 | 2.6 | + |

TABLE 2

| Lamination Temperature of 375° F. | | |
|---|---|---|
| DTC | PEEL FORCE (N/cm) | RESULTS* |
| Control #2 | 3.5 | x |
| Experiment #5 | 1.4 | o |

*x = Complete delamination of DTC, no ripping of DTC.
o = Partial delamination of DTC, ripping of DTC.
+ = No delamination of DTC, ripping of DTC.

The above results show that the prior art adhesives either failed to adhere to the receiver, or allowed complete delamination of the cover sheet without any ripping or tearing. The adhesives of the invention adhered more strongly to the receiver, resulting in ripping of the DTC.

G. Chemical Resistance

After lamination of the DTC to the topmost layer of the receiver element, the Status A red density of a cyan color bar appearing in the image was measured in two different places using an X-Rite® Densitometer (X-Rite Inc., Grandville, Mich.) and the mean density calculated and recorded. The protected receiver elements were then immersed in each of the solvents listed in Table 3 for the duration noted.

TABLE 3

| | |
|---|---|
| Solvent 1 | 100% isopropanol - 4 hrs exposure |
| Solvent 2 | a solution composed of 60 wt % ethanol in water - 4 hrs exposure |
| Solvent 3 | Undiluted household bleach (5.25% sodium hypochlorite) - 4 hrs exposure |
| Solvent 4 | a solution composed of 50 wt % ethylene glycol in water - 4 hrs exposure |
| Solvent 5 | a synthetic fuel composed of 30 wt % toluene in 70 wt % isooctane - 2 hrs |
| Solvent 6 | 100% trichloroethylene - 1 min. |

The receiver sample was then removed from the solvent. After removal, the sample was allowed to air dry for solvents 1, 5 and 6. The sample was rinsed in deionized water and then dried for solvents 2, 3 and 4. After drying, the Status A densities of the color bar were reread at the same location and the mean density recorded. The percent loss of dye density in the color bar was calculated from the following formula:

$$\% \text{ LOSS}=((I-F)/I)*100$$

where

I=Initial Status A Density

F=Final Status A Density

The lower the value of % LOSS the better the performance of the DTC. The values obtained are given in Table 4.

TABLE 4

| Solvent # | Durable Topcoat (DTC) | Cyan Dye Loss |
|---|---|---|
| 1 | None | 4% |
| 2 | None | 17% |
| 3 | None | 5% |
| 4 | None | 1% |
| 5 | None | 85% |
| 6 | None | 85% |
| 1 | Expetiment #2 | 2% |
| 2 | Experiment #2 | 1% |
| 3 | Experiment #2 | 4% |
| 4 | Experiment #2 | 0% |
| 5 | Experiment #2 | 0.3% |
| 6 | Experiment #2 | 0.3% |

The above results show that adhesive of the invention allowed the protective sheet to provide resistance to chemical attack at the edges, as compared to the control receiver without any protective laminate.

H. Abrasion Resistance

To measure abrasion resistance, two samples of receiver elements were prepared by application of DTC Experiment #2 after printing of a blue and black patch image on the receiver. Two samples of the receiver element, having only the printed image (i.e., no laminated DTC) were used as a control.

The samples were submitted to Taber abrasion testing using a CS10F wheel with a head weight of 250 g. Samples were submitted for 500 and 1000 cycles. Density measurements of the samples were taken before and after abrasion testing. Red, green, and blue Status A reflection densities were measured in four different places for each color patch on the samples corresponding to the area to be abraded. The mean density was calculated and recorded. The sample procedure was repeated following Taber testing. The percent loss of dye density in the color patches was calculated and used to determine DTC effectiveness. The lower the value of % LOSS, the better the performance of the DTC. The values obtained are given in Table 5.

TABLE 5

| Sample ID | # of Cycles | BLACK PATCH % Loss Red | BLACK PATCH % Loss Green | BLACK PATCH % Loss Blue | BLUE PATCH % Loss Red | BLUE PATCH % Loss Green | BLUE PATCH % Loss Blue |
|---|---|---|---|---|---|---|---|
| No DTC (control) | 500 | 57.8 | 46.9 | 35.6 | 54.9 | 43.1 | 33.3 |
| DTC Experiment #2 | 500 | 24.8 | 22.3 | 18.4 | 19.2 | 13.1 | 4.1 |
| No DTC (control) | 1000 | 82.5 | 72.7 | 62.8 | 81.3 | 70.4 | 57.6 |
| DTC Experiment #2 | 1000 | 21.3 | 18.3 | 15.4 | 18.4 | 12.2 | 2.9 |

The above results show that show that adhesive of the invention allowed the protective sheet to provide resistance to abrasive attack, as compared to the control receiver without any protective laminate.

The invention has been described in detail with particular reference to preferred embodiments thereof, but it will be understood that variations and modifications can be effected within the spirit and scope of the invention.

What is claimed is:

1. A dye-receiver element comprising a support having thereon a dye-receiving layer containing a thermally-transferred dye image, said dye-receiving layer being laminated to a transparent protective sheet by means of an adhesive comprising a phenoxy resin.

2. The element of claim 1 wherein said phenoxy resin comprises

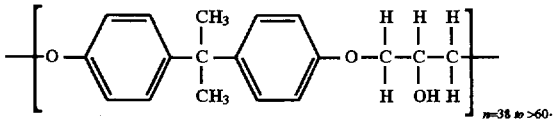

3. The element of claim 1 wherein said adhesive also comprises a crosslinking agent.

4. The element of claim 3 wherein said crosslinking agent is a titanium alkoxide.

5. The element of claim 4 wherein said titanium alkoxide is titanium butoxide and is present in an mount from about 0.01 $g/m^2$ to 0.045 $g/m^2$.

6. A process of laminating a transparent protection sheet on top of a thermal dye transfer image comprising:

(I) imagewise-heating a dye-donor element comprising a support having thereon a dye layer comprising an image dye in a binder, said dye-donor being in contact with a dye-receiving element, thereby transferring a dye image to said dye-receiving element to form said dye transfer image; and (II) thermally laminating said transparent protection sheet on top of said transferred dye image by means of an adhesive comprising a phenoxy resin.

7. The process of claim 6 wherein said phenoxy resin comprises

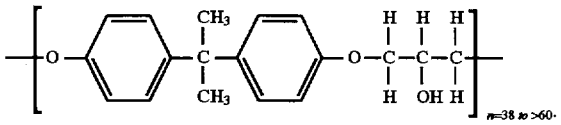

8. The process of claim 6 wherein said adhesive also comprises a crosslinking agent.

9. The process of claim 8 wherein said crosslinking agent is a titanium alkoxide.

10. The process of claim 9 wherein said titanium alkoxide is titanium butoxide and is present in an mount from about 0.01 $g/m^2$ to 0.045 $g/m^2$.

* * * * *